US009314670B2

(12) United States Patent
Szabo

(10) Patent No.: US 9,314,670 B2
(45) Date of Patent: Apr. 19, 2016

(54) GRAVITY MAT

(71) Applicant: Jonathan Szabo, Bethlehem, PA (US)

(72) Inventor: Jonathan Szabo, Bethlehem, PA (US)

(73) Assignee: Jonathan Szabo, Bethlehem, PA (US)

( * ) Notice: Subject to any disclaimer, the term of this patent is extended or adjusted under 35 U.S.C. 154(b) by 0 days.

(21) Appl. No.: 14/485,757

(22) Filed: Sep. 14, 2014

(65) Prior Publication Data

US 2015/0080192 A1 Mar. 19, 2015

(51) Int. Cl.

| | |
|---|---|
| ***A63B 26/00*** | (2006.01) |
| ***A63B 21/002*** | (2006.01) |
| ***A63B 22/20*** | (2006.01) |
| ***A63B 71/00*** | (2006.01) |
| ***A63B 21/055*** | (2006.01) |
| ***A63B 21/00*** | (2006.01) |
| ***A63B 21/02*** | (2006.01) |
| ***A63B 23/035*** | (2006.01) |

(52) U.S. Cl.

CPC ..... *A63B 26/003* (2013.01); *A63B 21/0023* (2013.01); *A63B 21/00061* (2013.01); *A63B 21/025* (2013.01); *A63B 21/0552* (2013.01); *A63B 21/4015* (2015.10); *A63B 22/20* (2013.01); *A63B 22/203* (2013.01); *A63B 23/03566* (2013.01); *A63B 71/0036* (2013.01); *A63B 2208/0214* (2013.01); *A63B 2209/10* (2013.01); *A63B 2225/09* (2013.01)

(58) Field of Classification Search

CPC ..... A63B 21/04–21/0435; A63B 21/055–21/0557; A63B 21/4029; A63B 21/4031; A63B 21/4033–21/4035; A63B 21/4045; A63B 22/0087–22/0089; A63B 22/20–22/203; A63B 22/208; A63B 23/02–23/0238; A63B 26/003

See application file for complete search history.

(56) References Cited

U.S. PATENT DOCUMENTS

| | | | | |
|---|---|---|---|---|
| 6,561,957 | B1 * | 5/2003 | Read | A63B 21/012 482/94 |
| 7,935,032 | B1 * | 5/2011 | Jackson | A63B 22/0046 482/70 |
| 2003/0109365 | A1 * | 6/2003 | Smith | A63B 23/00 482/146 |
| 2008/0026918 | A1 * | 1/2008 | Lemke | A63B 21/055 482/87 |

* cited by examiner

*Primary Examiner* — Loan H Thanh
*Assistant Examiner* — Jennifer M Deichl

(57) ABSTRACT

In one aspect of the disclosed embodiments, an exercise device is provided as two similar pedestals, each having an optionally compressible base and a set of feet which interlock within a positioning mat. A set of horizontal outer rails attached to the top of each base and a set of perpendicular inner rails, linearly connected to the outer rails and slidable along the outer rails. A user support platform linearly connected to the set of inner rails and slidable along the inner rails. A plurality of resistance members is provided to supply resistance. The said components of the exercise device provided allow for an exerciser positioned and either partially or totally supported by the user support platforms to propel their body parts being supported in an multi-directional space against resistance. The resistance provided is directed towards a centralized equilibrium position.

3 Claims, 10 Drawing Sheets

GRAVITY MAT

CROSS-REFERENCE TO RELATED APPLICATIONS

This application claims priority from Provisional Patent Application Ser. No. 61/877,905 filed Sep. 13, 2013.

BACKGROUND OF THE INVENTION

Isometric exercises are very useful for strength training and conditioning the muscles. Just like holding a dumbbell out to the side for an amount of time, isometric exercises are static exercise where a position is held against some form of resistance.

Isotonic exercises are the opposite of isometric exercises: They require moving and working your muscle(s) through a range of motion. Isometric exercises are the most common type of strength training exercises people do such as lifting weights, calisthenics and cycling.

Stability exercises develop proximal control in certain positions such as partially supporting yourself on one hand by an exercise ball, forcing your muscles to react in order to remain in the position.

Dancing as a form of exercise has become very popular. Activities like dancing are fun and offer many health benefits. Music and rhythmic motion can be an escape from traditional exercise which can become very boring and repetitive.

Dancing can have its drawbacks. In particular, in order to dance one must have rhythm. Most people do not have natural rhythm when it comes to dancing and must train their bodies to move in a particular way to accomplish this goal.

There is, thus, a need for exercise equipment which is capable of delivering both isotonic and isometric exercises, stability training, and assisting the body in creating rhythmic motion along with strengthening and training the muscles needed to effectively set their body in rhythmic motion without such exercise equipment. Those who value versatility in an exercise device or want to develop rhythmic muscle memory would appreciate this unique invention.

BRIEF SUMMARY OF THE INVENTION

The invention includes a device comprised of two similar pedestals capable of sustaining partial or total weight from a user. Each pedestal has a platform that has a central base mount that is linearly connected to two rails that make it free to move in a forward and backwards direction where linear motion bearings provide low friction, optional resistance members connect to the base of the platform and the support bracket of the rails in order to provide adjustable resistance in both the forward and backward directions, two more rails perpendicular to the aforementioned rails that support the aforementioned parts at the support bracket of the aforementioned rails and attach to the base with separate support mounts, allowing the platform to move in a side to side motion where linear motion bearings provide low friction, optional resistance members attach to the support bracket of the first set of rails and the support mounts of the second set of rails to provide adjustable resistance in both directions of sideways motion, a base that the aforementioned parts are mounted on top of, comprised of springs sandwiched between two flat plates, making the plates free to compress and supplying the platform with up and down motion, retaining straps connecting the flat plates, a series of posts that provide a lower limit that each corner of the base can compress, a series of adjustable posts pivotally connected to each first series of posts, that turn, locking one or more of the corners of the plates in place preventing compression, a positioning mat in which the pedestal's feet interlock with allowing for positioning of the platforms, foldable cushions that attach to the front and back of the mat that allow for an elevated partial support of a user, hand grips connected to the top of the front cushion, grip strips connected to the top of the rear cushion, interchangeable platform assemblies that change the shape of the platform in order to accommodate different body parts from an exerciser.

BRIEF DESCRIPTION OF THE SEVERAL VIEWS OF THE DRAWING

The accompanying drawings, which are incorporated in and constitute a part of the specification, illustrate some of the embodiments of the invention and, together with the description, serve to explain the objects, advantages, and principles of the invention. In the drawings.

DETAILED DESCRIPTION OF THE INVENTION

Prior to explaining in detail the following invention, it is to be understood that the invention is not to be limited in its application to the methods described in the accompanying drawings, since the invention is capable of being used in various ways for multiple purposes. Also, it is to be understood that the phraseology and terminology used herein is for the purpose of description and not limitation.

Figure 1:
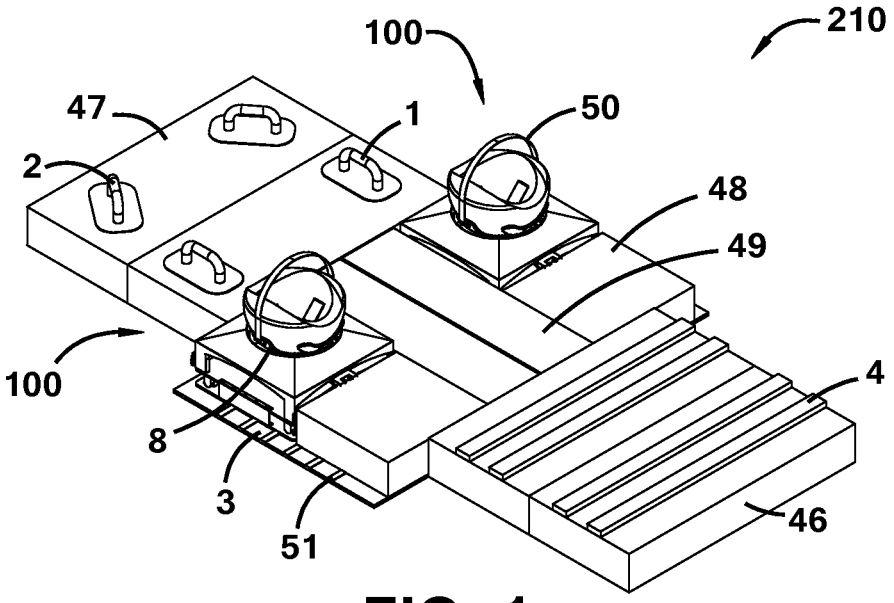
FIG. 1 is a perspective view of an embodiment of an exercise device with accessories attached 210.
Figure 2:
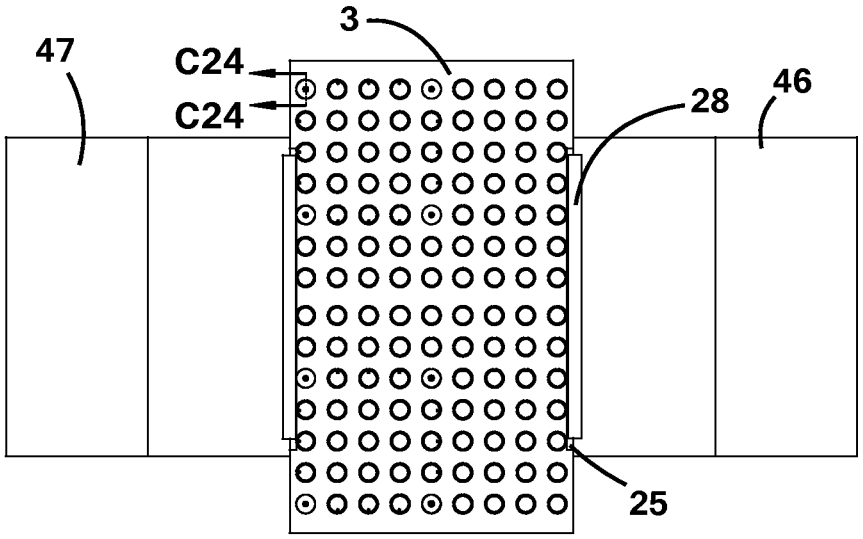
FIG. 2 is a bottom view of the exercise device shown in FIG. 1.
Figure 27:
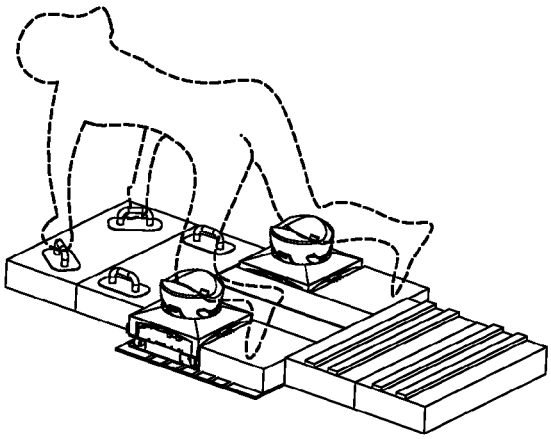
FIG. 27 is a perspective view of an outline of a woman using the device for dance and exercise, illustrating yet another one of the many ways the invention may be used.

With reference to FIGS. 1-2 an exercise device 200 is shown with accessories attached. Accessories 46-49, labeled in FIG. 1 are comprised of foldable cushions made from a suitable foam and upholstered with a suitable durable fabric. On the top surface of upper cushion 47, upper grips 2 and lower grips 1 are made from a suitable rigid material and only one is labeled due to symmetry. Upper grips 2 and lower grips 1 are attached for grasping by the hands of a user for partial support as shown in FIG. 27. On the top surface of lower cushion 46, grip strips 4 are attached to the fabric to give added grip for an exerciser occupying that area. Grip strips 4 are made from foam or rubber and only one is labeled due to symmetry. Carry straps 50 are made from a suitable fabric mesh and only one is labeled due to symmetry. Carry straps 50 are connected through slits in shell pad base 8 and fasten to themselves with hook and loop fastening tape (not shown), and can be used to transport or position pedestal 100 or tie down a body part of a user duding vigorous use. Upper cushion 47 and lower cushion 46 are split in half and stitched together at the top seem where the halves meet in order to fold in half when detached for storage, or provide an optional height level of partial support of a user. Both upper cushion 47 and lower cushion 46 shown in FIG. 2 have cushion tape 28, made from the hook side of common hook and loop fastening tape, stitched about the bottom edge where they meet positioning mat 3 hooks facing up in order to attach to the bottom of the mat 3 as shown in FIG. 2. On the edge of positioning mat 3 as shown in FIG. 2, the lower mat tape 25 is comprised of the loop side of common hook and loop fastening tape, and is attached to the positioning mat 3 to accept the attachment of upper cushion 47 and lower cushion 46 and only one is labeled due to symmetry. The top of the positioning mat 3 as shown in FIG. 1, where square mid cushions 48 and rectangle mid cushions 49 are placed, the loop side of hook and loop fastening tape, upper mat tape 51 is attached. Square mid cushions 48 and rectangle mid cushions 49 are made from similar material as the aforementioned cushions and only one of each is labeled due to symmetry, and have the hook side of common hook and loop fastening tape (not shown) attached to the bottom surface in order to be temporarily fastened to upper mat tape 51 on the top of the positioning mat 3 when needed. Lower mat tape 25, upper mat tape 51, cushion tape 28, and hook side of hook and loop fastening tape (not shown) attached to the bottom of square mid cushions 48 and rectangle mid cushions 49 is made from common hook and loop fastening tape and only one of each cushion is labeled due to symmetry.

Figure 4:
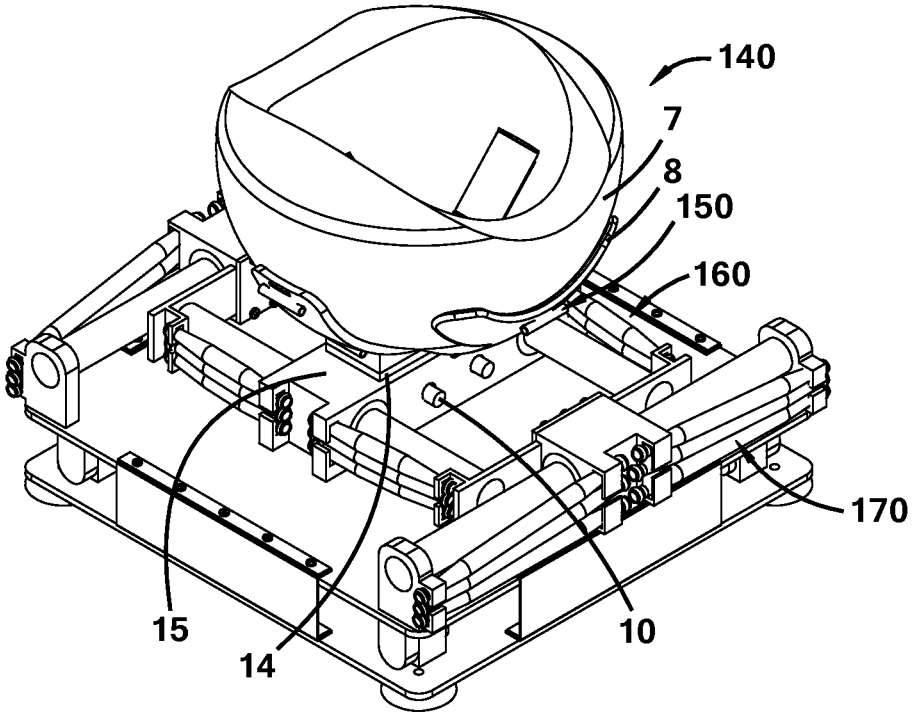
FIG. 4 is an expanded perspective view of pedestal assembly 100 shown in FIG. 3 with dust cover 9 removed.
Figure 5:
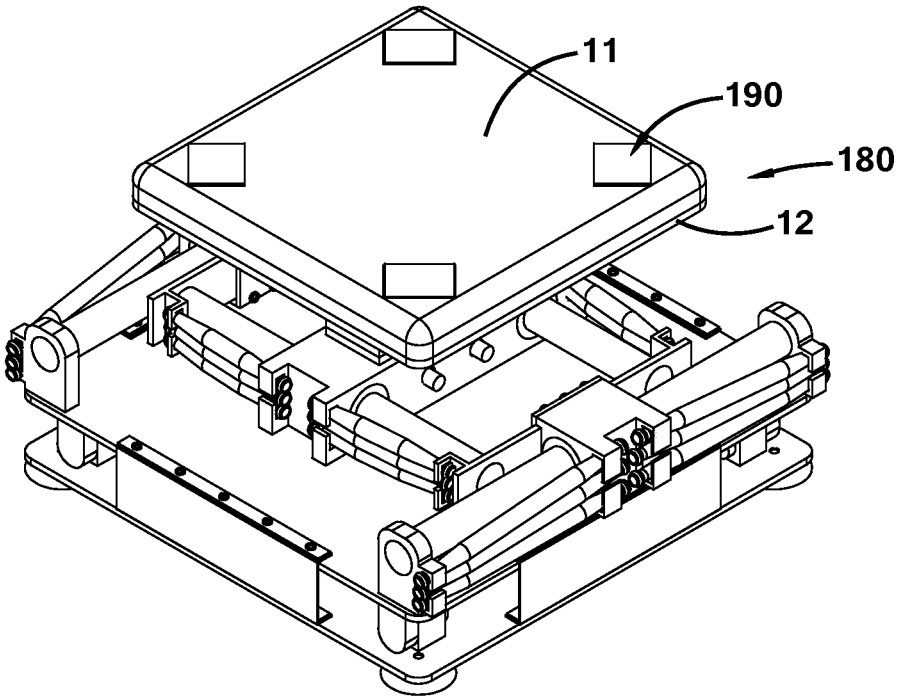
FIG. 5 is a perspective view of the portion of the exercise device in FIG. 4 with flat platform assembly 180 attached, replacing shell platform assembly 140.
Figure 19:
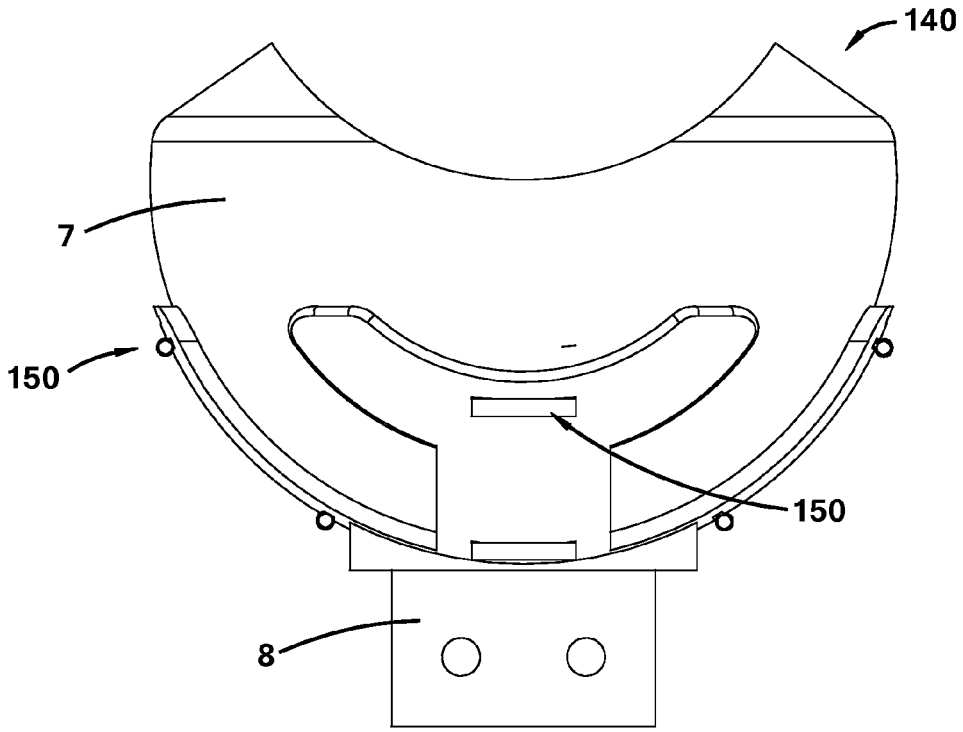
FIG. 19 is a rear view of shell platform assembly 140.
Figure 20:
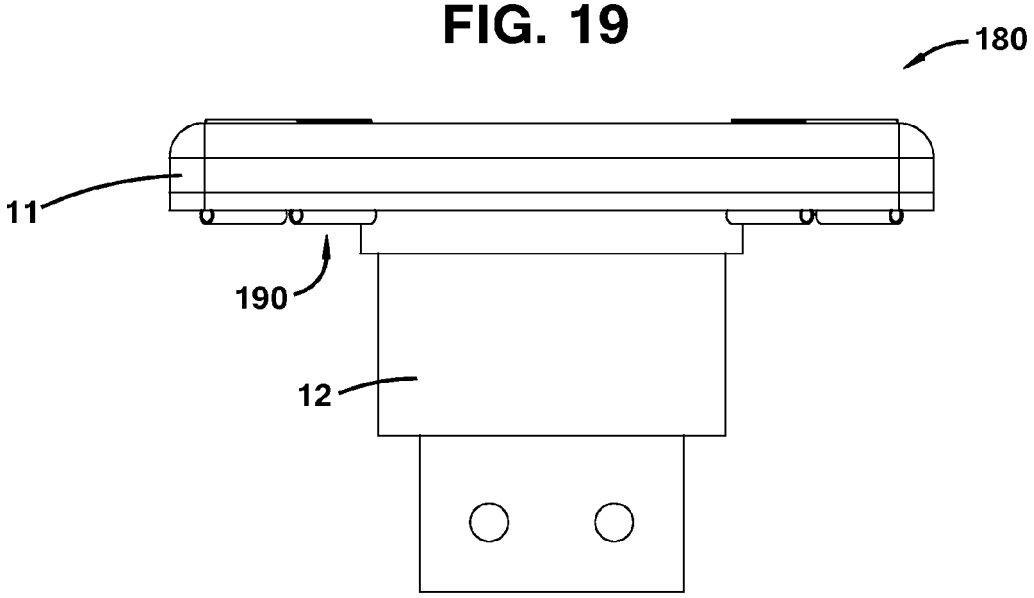
FIG. 20 is a rear view of a flat platform assembly 180.
Figure 25:
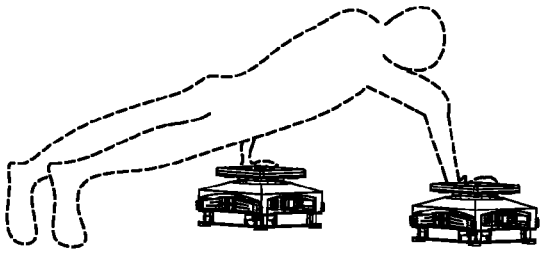
FIG. 25 is a perspective view of an outline of a man using the device to enhance pushups, illustrating one of the many ways the invention may be used.
Figure 26:
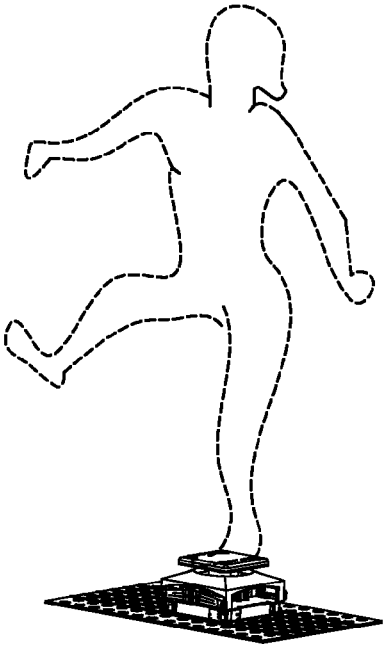
FIG. 26 is perspective view of an outline of a woman balancing on the device illustrating another one of the many ways the invention may be used.

Flat platform assembly 180 shown in FIGS. 5 and 20, is a flat user support platform that is interchangeable with the shell platform assembly 140 shown in FIGS. 4 and 19. Flat platform assembly 180 attaches such that it transforms the bowl shape platform into a flat square shape in order to accommodate different body parts of a user as shown in FIGS. 25-27.

Figure 3:
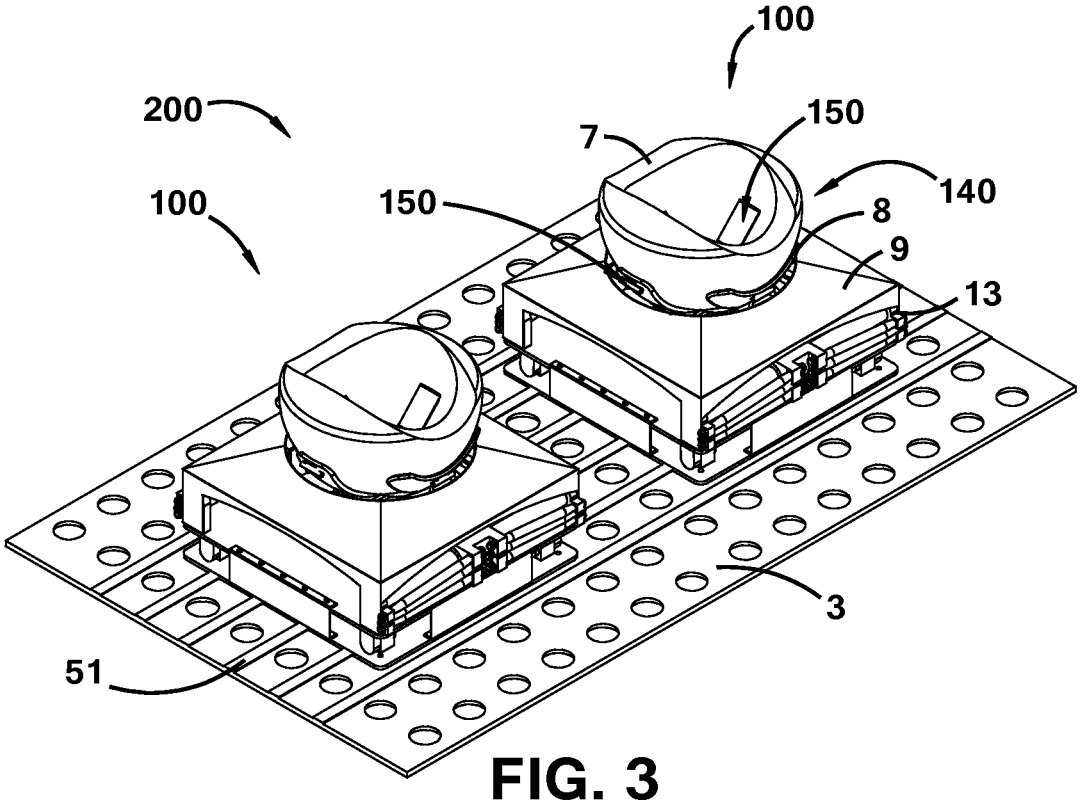
FIG. 3 is an expanded perspective view of an embodiment of an exercise device 200 as shown in FIG. 1 with lower hand grips 1, upper hand grips 2, grip strips 4, cushions 46-49 and carry straps 50 removed, and pedestals 100 repositioned.

One of two identical pedestals Assemblies 100, pictured in FIG. 3 is now described. A dust cover 9 is made from a suitable flexible, stretchable fabric and fits tightly around the pedestal, attaching at rail base mounts 13. There are four rail base mounts 13, one on each corner, and only one is shown due to symmetry. Dust cover 9 does not impede the motion of the platform and only one of two is labeled due to symmetry.

The Pedestal 100 labeled in FIG. 3 is pictured in FIG. 4. with dust cover 9 removed is now described in parts.

With reference to FIGS. 3-5 and FIGS. 17-20, the interchangeable user support platforms are now described. Shell platform assembly 140 consists of a shell pad 7 that is made of a suitable foam or rubber and shaped like a contoured half spherical shell, a shell pad base 8 that is made of a suitable rigid material and contoured to accept shell pad 7, and shell connecting straps 150, that attach shell pad 7 to shell pad base 8. Flat platform assembly 180 comprises flat pad 11 made from a similar material as the previously mentioned shell pad, a flat pad base 12 made from a similar material as the previously mentioned shell pad base 8, and flat connecting straps 190, that attach flat pad 11 to flat pad base 12.

Shell connecting straps 150 and flat connecting straps 190 are pictured in FIGS. 3-5 and FIGS. 17-20. The flat mesh 41 and shell mesh 43 are made from a suitable fabric mesh and stitched in a loop at each end. The straps are placed through slits in the pads and pad bases from the top of the pad until the loop side is exposed on the bottom of the pad base. Shown in FIGS. 17-18, a dowel 42 made from a suitable rigid material is then inserted into the cylindrical sleeve created by the loop in the mesh and is sized so that it does not allow the loop to pass back through the slit in the pad base thus keeping the pad fastened to the pad base as shown in FIGS. 19-20.

Figure 6:
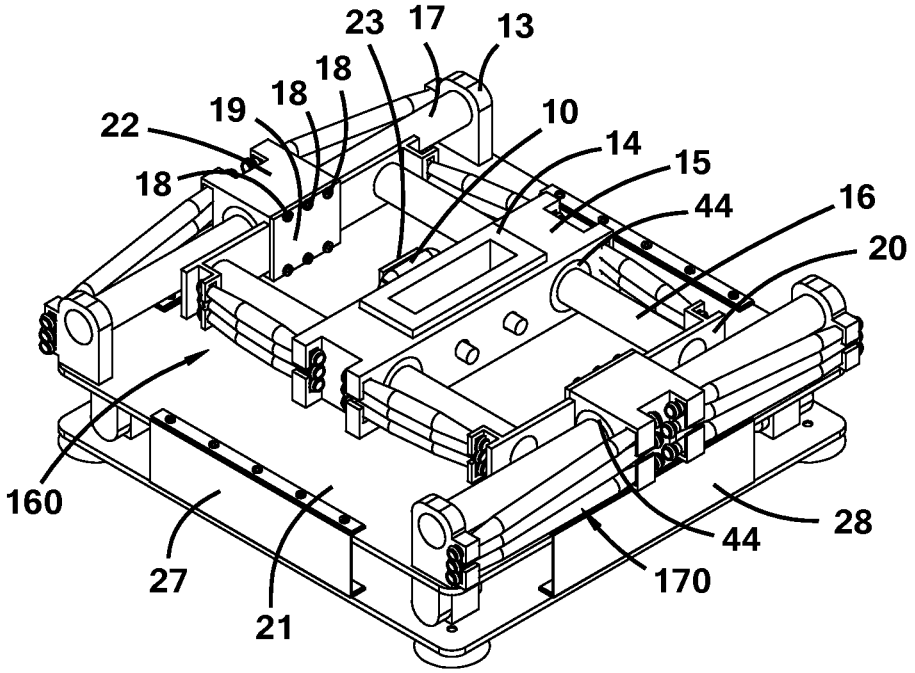
FIG. 6 is a perspective view of the device as shown in FIG. 4 with shell platform assembly 140 removed.
Figure 7:
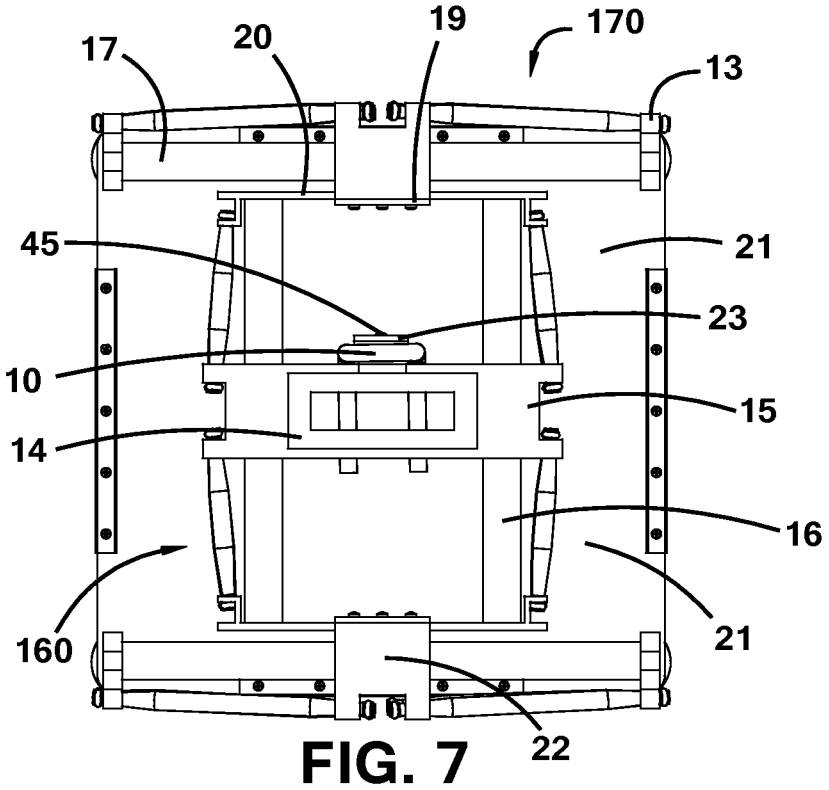
FIG. 7 is a top view of the portion of the device shown in FIG. 6.
Figure 8:
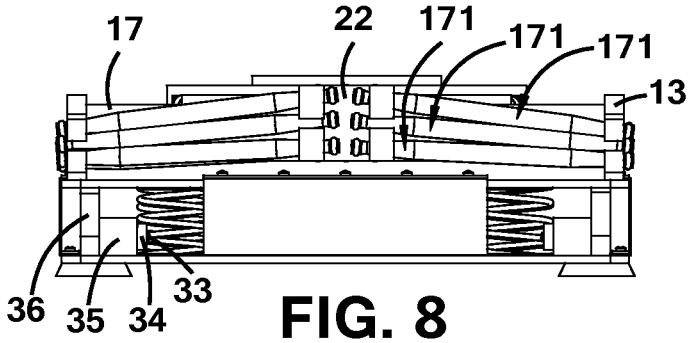
FIG. 8 is a front view of the portion of the device shown in FIG. 6.
Figure 21A:
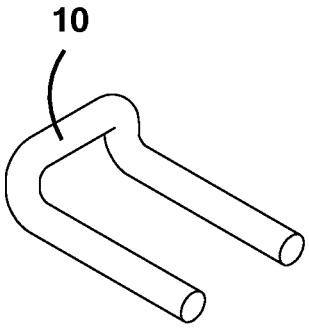
FIG. 21A is a perspective view of retaining pin 10.
Figure 21B:
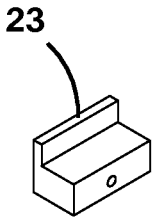
FIG. 21B is a perspective view of retaining pin keeper 23.
Figure 21C:
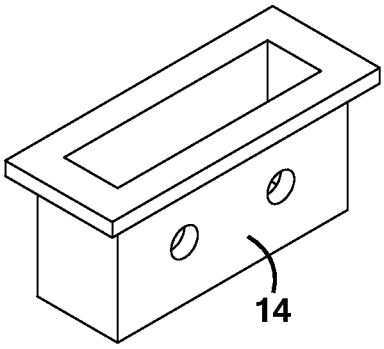
FIG. 21C is a perspective view of platform mounting sleeve 14.

With reference to FIGS. 6 and 7 the mounting means of the platform assemblies comprises a rubber mounting sleeve 14 as shown in FIG. 21C, shaped on the inside to accept the bottom of shell pad base 8 and flat pad base 12, and shaped on the outside to fit into the platform mount 15, and has holes to accept the insertion of the retaining pin 10, a platform mount 15 made from a suitable rigid material, that has holes to accept common linear bearings 44, mounting sleeve 14, retaining pin 10, and perpendicular elastic group 160.

Figure 22:
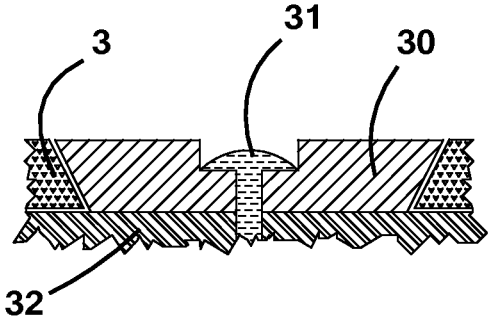
FIG. 22 is cross section view C24-C24 shown in FIG. 2 of the interlocking connection between the pedestals base foot 30 and positioning mat 3.

Retaining pin 10 pictured in FIGS. 6,7 and 21 is made from a suitable rigid material. Retaining pin 10 is removed to change platforms and inserted through the holes in the front of the platform mount 15, the mounting sleeve 14 and shell pad base 8 or flat pad base 12 to secure the platforms to the base. A rubber retaining pin keeper 23 is attached with keeper screw 45, through a hole in the front of the retaining pin keeper into a threaded hole in the front of platform mount 15. Platform mount 15 has a notch near retaining pin 10 cross-member for easy grip on retaining pin 10 during removal. The retaining pin keeper 23 is shaped and positioned below retaining pin 10 such that its thin tab shown in FIG. 22 contacts the cross member of the retaining pin 10 and adds friction during removal in order to keep retaining pin 10 from slipping out of place during use.

As shown in FIGS. 6 and 7, common linear bearings 44 and parallel rails 16 supply the platform with linear motion in the front to back direction. There are two parallel rails 16 and two attached linear bearings 44 and only one of each is labeled due to symmetry. The two parallel rails 16 are made from a hardened rigid material and attach to mounting bracket 20 as shown in FIGS. 6 and 7 and only one is labeled due to symmetry. Two rail brackets 20 are made from a suitable rigid material and have holes to accept parallel rails 16 where they are permanently fixed and only one is labeled due to symmetry. The ends of rail bracket 20 have extensions with holes to accept perpendicular elastic group 160. Platform mount 15 also has extensions with holes cut out to accept perpendicular elastic group 160 and each hole on both rail bracket 20 and platform mount 15 have a slot in the side in order for removal or placement of perpendicular elastic group 160.

Figure 9:
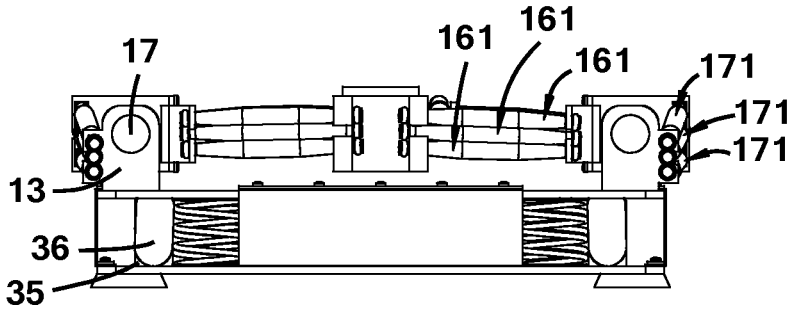
FIG. 9 is a left side view of the portion of the device shown in FIG. 6
Figure 12:
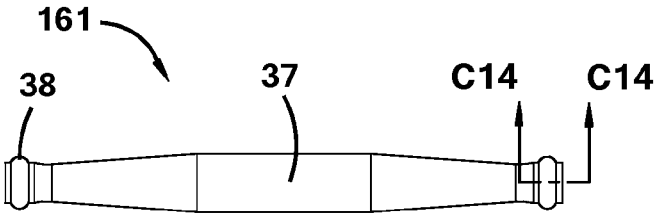
FIG. 12 is an expanded side view of a single perpendicular resistance member 161 shown in FIG. 9.
Figure 13:
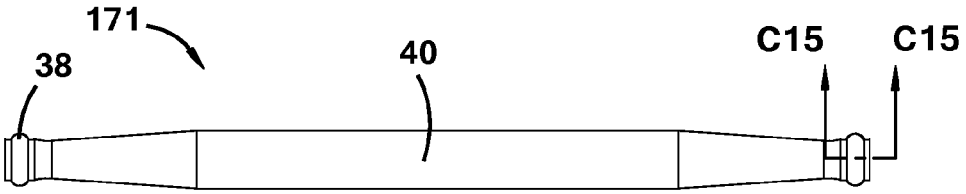
FIG. 13 is an expanded front view of a single horizontal elastic resistance member 171 shown in FIGS. 8 and 9.
Figure 14:
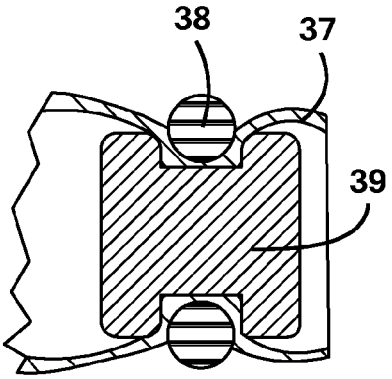
FIG. 14 is cross section view C14-C14 shown in FIG. 12 of the end attachment of a single perpendicular resistance member 161.
Figure 15:
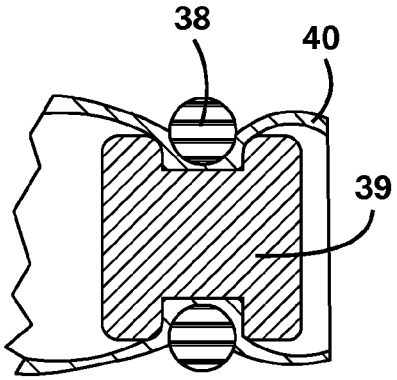
FIG. 15 is cross section view C15-C15 shown in FIG. 13 of the end of a single horizontal resistance member 171.

With reference to FIGS. 4, 6 perpendicular elastic group 160 is described, there are four sets and only one is labeled due to symmetry. Each individual perpendicular resistance member 161 shown in FIG. 9 is made from an elastic means with end attachment and when pinched or stretched is removable from the device through a slot in the holes on rail bracket 20 and platform mount 15. Perpendicular resistance member 37 can be made from any elastic means, here it is made from common elastic resistance tube. As shown in FIG. 12 is a single perpendicular resistance member 161 and accompanying end attachments. FIG. 14 shows a cross section labeled in FIG. 12 one end attachment. The end attachment is comprised of an insert 39 and a containment ring 38 both made from a suitable rigid material. Insert 39 is a cylinder with a channel and is inserted into each end of perpendicular resistance member 37. Containment ring 38 is clamped around the perpendicular resistance member 37 at the spot of the channel such that it squeezes the tube against the insert channel and creates enough friction to stay in place during use and form a solid end to the flexible tube. Containment ring 38 is sized such that it will not pass through the holes or slots in rail bracket 20 or platform mount 15 during use.

FIG. 6 shows bracket mount 22, bracket plate 19 and bracket mounting screws 18 all made from a suitable rigid material. There are 2 bracket mounts 22, bracket plates 19 and rail brackets 20 and only one is labeled due to symmetry. There are a total of twelve bracket mounting screws 18 and only three are labeled due to symmetry. Bracket mount 22 has a channel on the edge to accept rail bracket 20 and a hole to accept linear bearing 44. Bracket plate 19 is attached to bracket mount 22 with bracket mounting screws 18 through a hole in bracket plate 19 and a threaded hole in bracket mount 20. The bracket mounting assembly along with linear bearing 44 and horizontal rails 17 provide the platform with linear motion in the side to side direction where rail bracket 20 passes by rail base mount 13 with no contact.

Two Horizontal rails 17 are made from a suitable hardened rigid material and only one is labeled due to symmetry. Horizontal rails 17 are supported by and attached permanently to rail base mounts 13. Rail base mounts 13 are made from a suitable rigid material and attached permanently to the top of upper base plate 21. There are four rail base mounts 13 and only one is labeled due to symmetry. Horizontal elastic group 170 is connected to the rail base mounts 13 and bracket mount 22 in a similar fashion as the previously mentioned perpendicular elastic group 160 and provides the platform with resistance opposing the side to side motion of the platform when a user applies a force. Both sets of elastic groups provide resistance that forces the platform to its central equilibrium state and have a plurality of different resistance ratings and lengths giving the user optional levels of resistance. Horizontal rails 17 and attached common linear bearings 44 provide the user support platforms with linear motion in the side to side directions and only one is labeled due to symmetry.

Figure 10:
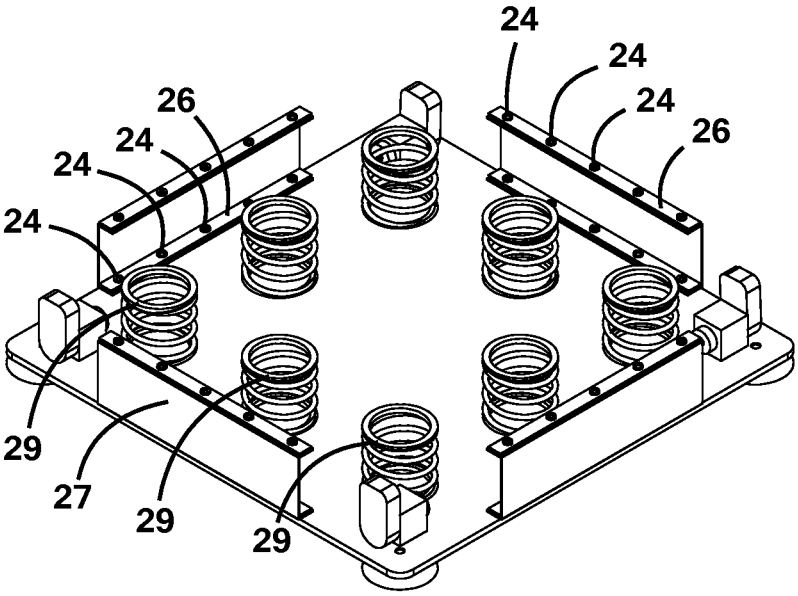
FIG. 10 is a perspective view of the portion of the device shown in FIGS. 6 and 7 with retaining pin 10, retaining pin keeper 23, keeper screw 45, platform mounting sleeve 14, platform mount 15, parallel rails 16, perpendicular elastic group 160, rail bracket 20, bracket mount 22, bracket plate 19, horizontal elastic group 170, horizontal rails 17, linear bearings 44, rail base mounts 13, bracket mounting screws 18, and upper base plate 21 removed.
Figure 11:
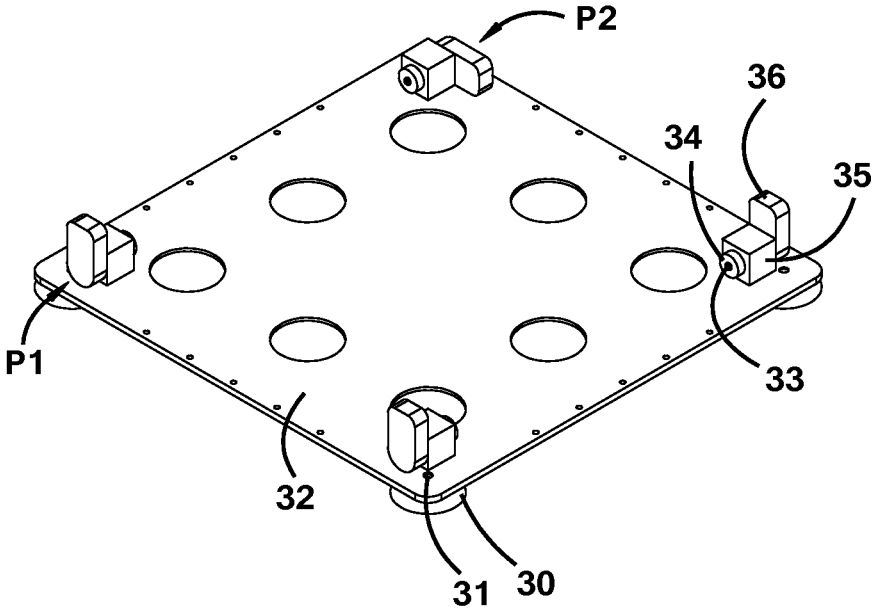
FIG. 11 is a perspective view of the portion of the device shown in FIG. 10 with springs 29, base retaining straps 27, strap plates 26, and strap plate screws 24 removed and illustrates an alternate positioning of adjustable limiting post 36.
Figure 16:
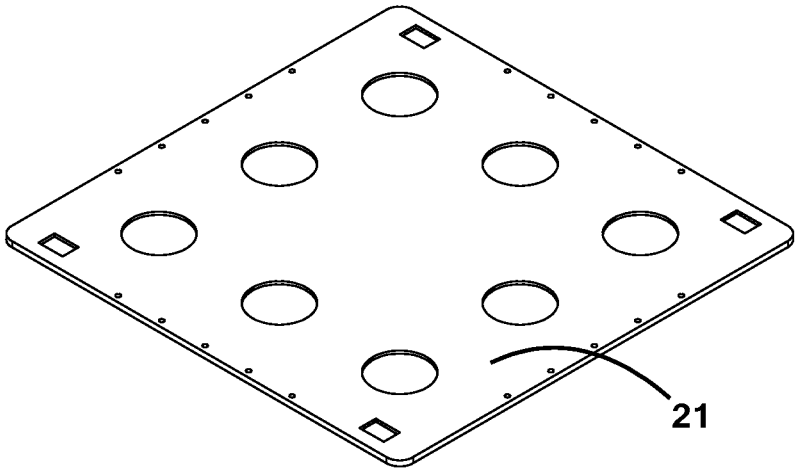
FIG. 16 is a perspective view of the bottom of upper base plate 21.
Figure 17:
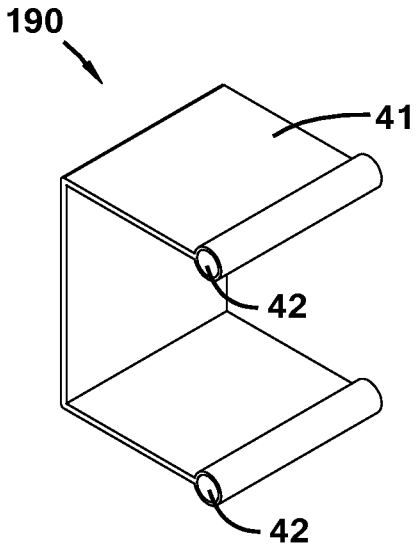
FIG. 17 is a perspective view of flat connecting strap 190 that holds flat pad 11 onto flat platform assembly 180 as shown in FIG. 5 and FIG. 20.
Figure 18:
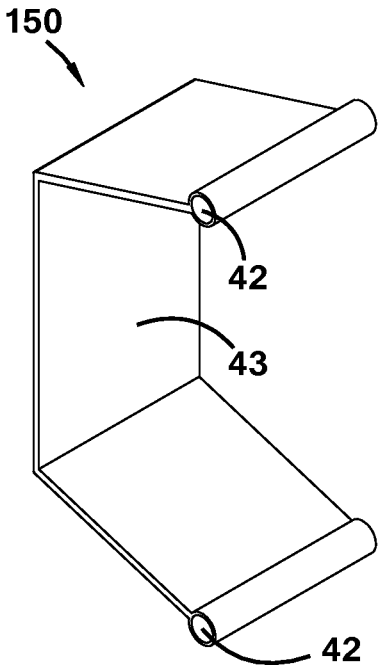
FIG. 18 is a perspective view of a single shell connecting strap 150, that holds shell pad 7 onto shell platform assembly 140 as shown in FIG. 4 and FIG. 19.

With reference to FIGS. 6 and 10, upper base plate 21 is made from a suitable rigid material and is supported by a set of nine common compressible springs 29. Only three springs 29 are labeled due to symmetry and are made from a suitable resilient rigid material. Springs 29 are supported by lower base plate 32 which is made from a suitable rigid material. As shown in FIGS. 11 and 16, the bottom surface of upper base plate 21 and the top surface of lower base plate 32 have recessed cylindrical channels to accept and retain springs 29 when the device is assembled and in use. The bottom of upper base plate 21 has rectangular channels to accept adjustable limiting posts 36.

As shown in FIGS. 6 and 10, base retaining straps 27 are made from a suitable strong fabric mesh, there four and only one is labeled due to symmetry. Base retaining straps 27 are each fastened to the top of upper base plate 21 and the top of lower base plate 32 such that they maintain a distance between base plates 21 and 32 where springs 29 are compressed with minimal tension. Minimal compression of the springs 29, keeps the ends of the springs 29 contained within the recessed cylindrical channels of upper base plate 21 and lower base plate 32. Strap plates 26 are made from a suitable rigid material, there are eight of each and only two are labeled due to symmetry. Strap plates 26 are placed above the edges of base retaining straps 27 and screwed down tightly with strap plate screws 24 through holes in the strap plates 26 and threaded holes in upper base plate 21 and lower base plate 32. There are forty strap plate screws, made from a suitable rigid material, and only six are shown due to symmetry. Base plates 21 and 32 are compressible using springs 29 when a force is applied by a user.

Figure 23:
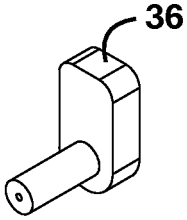
FIG. 23 is a perspective view of adjustable limiting post 36 shown in FIG. 11.
Figure 24:
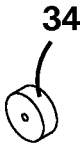
FIG. 24 is a perspective view of end cap 34 shown in FIG. 11.

With reference to FIGS. 11, 23 and 24 lower limiting post 35, adjustable limiting posts 36, shaft caps 34, and cap screws 33 are made from a suitable rigid material, there are four of each and only one is labeled due to symmetry. Lower limiting post 35 is a small cube with a hole directly through one side and out of the other. Adjustable limiting post 36 is solid and rectangular with rounded edges and has a cylindrical shaft on one side. The cylindrical shaft is inserted through lower limiting post 35 and capped with shaft cap 34. Shaft cap 34 is fastened with cap screw 33. Here adjustable limiting post 36 may be rotated about the axis of the cap screw 33. There are two ways that the limiting post assemblies can be oriented during use. Configuration P1 shows the limiting post assemblies at high position such that they keep the corner of the base that it is positioned near in a locked high position. Configuration P2 shows the limiting post assemblies at low position allowing the springs near the corner of the base that it is positioned by to compress during use. Lower limiting posts 35 provides a limit in which the springs 29 can compress in order to prevent damage. In general, Springs 29 allow the base of pedestal 100, to compress when a user applies force and return to its state prior to the application of force.

As shown in FIG. 11, rubber base foot 30 is attached through a hole in base foot 30 and a threaded hole in base plate 32, with foot screw 31, to the bottom surface of lower base plate 32 at each corner, there are four and only one shown due to symmetry. Foot screw 31 is made from a suitable rigid material and only one is labeled due to symmetry.

The pedestal 11 can be placed on a firm flat surface during regular use or rubber base foot 30 can be interlocked with holes on positioning mat 3 for positioning and stability during vigorous use. As shown in FIG. 24, bottom cross-section C24-C24 shown in FIG. 2 shows the interlocking connection of base foot 30 and positioning mat 3 where the angle at which both parts are contoured and allows for base foot 30 and mat 3 to maintain connection when forces are applied during use.

FIGS. 25-27 show some of the various embodiments and uses for the device. In FIG. 25 a male user is in the push-up position with his hands on flat platform assembly 180. The user is free to move his hands independently in all directions against resistance for an isotonic exercise. He can move back and forth, side to side, or in a circular/elliptical motion or in an up and down bouncing motion against gravity and the compressible base. The user can also be assisted by the device to create a harmonic motion with his hands in such directions since the resistance provided will direct the platforms back to a central equilibrium position. The user could also hold a constant position against resistive force in his choice of direction for an isometric work-out or stay in a fixed position and be forced to stabilize himself.

FIG. 26 is an outline of a woman user with one foot on a single user support platform where she is forced to stabilize herself due to the motion of the support platform and compressible base. This is a good exercise for stability training and physical therapy.

FIG. 27 is an outline of a woman grasping the hand grips with her hands for partial support and resting her knees on the platforms for partial support. The user is free to move her knees independently in a front to back or side to side direction and in an up and down bouncing motion against gravity and the compressible base or circular/elliptical motion against adjustable resistance. Repeatedly Pushing the knees away from each other and dropping the elevation of the hips by straightening the lower back, then pulling them close together and raising the elevation of the hips by arching the back and engaging the lower back muscles, produces bouncing of the hips. Keeping the upper body at the same elevation throughout the exercise by bending at the lower back produces a desired dance motion within the hips. The resistance to motion of the knees is directed towards a central equilibrium position and the motion combined with resistance assists in creating rhythmic motion and rhythmic muscle memory within the user, especially when accompanied by the users favorite music.

I hereby claim:

1. An exercise device, comprising;

at least one pedestal wherein said at least one pedestal comprises:

a user support platform capable of sustaining weight from a user, movable by said user, and linearly connected to and supported by a first set of rails such that said user support platform is slidable along said first set of rails;

wherein said first set of rails is supported by and attached at a connection point at each of a first and second end of each of said first set of rails to a second set of rails such that said user support platform is slidable along said second set of rails;

wherein said second set of rails is perpendicular to said first set of rails and wherein each of said second set of rails has a first and second end attached to; and supported by a base;

a plurality of individually removable resistance members wherein each of said plurality of individually removable resistance members comprises a first and a second end that attach to respective mounting points on said pedestal in a first and second mounting position wherein:

in the first mounting position, at least one of said plurality of individually removable resistance members is attached between a mounting point at a centralized point on said platform and a mounting point on either the first or second end of one of said first set of rails and in the second mounting position at least one of said plurality of individually removable resistance members is attached between a mounting point near either the first or second end of one of said second set of rails and a centralized mounting point between either end of said one of said first set of rails at the connection point of said first and second set of rails such that resistance is generated when said user slides said user support platform along said first and said second set of rails, and said resistance is directed towards a centralized equilibrium position.

2. An exercise device as claimed in claim 1, wherein said base is compressible upon force applied by said user at said user support platform and comprises:

a first base plate connected to and supported by a set of compressible springs;

wherein said set of compressible springs is supported by and connected to a second base plate;

wherein said second base plate is supported by and attached to a set of feet;

wherein said set of feet-attached to a bottom of said second base plate at corners of said second base plate;

a set of adjustable limiting posts attached to a top of said second base plate at each of said corners having adjustable height for limiting a distance said set of compressible springs can be compressed and a distance between said first and second base plates when said user applies force at said user support platform.

3. An exercise device as claimed in claim 2, further comprising a positioning mat with detachable cushions wherein said set of feet on said base of each of said at least one pedestal interlocks with holes in said positioning mat for positioning by said user; and a set of detachable cushions that attach to said positioning mat to supply support to said user.

* * * * *